US008486355B2

(12) United States Patent
Sutcliffe et al.

(10) Patent No.: US 8,486,355 B2
(45) Date of Patent: Jul. 16, 2013

(54) METHOD FOR LEACHING COBALT FROM OXIDISED COBALT ORES

(75) Inventors: Matthew Leslie Sutcliffe, London (GB); Garry Mervyn Johnston, Claremont (AU); Nicholas James Welham, Ballarat (AU)

(73) Assignee: Metaleach Limited, Tortola (VG)

( * ) Notice: Subject to any disclaimer, the term of this patent is extended or adjusted under 35 U.S.C. 154(b) by 0 days.

(21) Appl. No.: 13/389,038

(22) PCT Filed: Aug. 6, 2010

(86) PCT No.: PCT/AU2010/001003
§ 371 (c)(1),
(2), (4) Date: May 21, 2012

(87) PCT Pub. No.: WO2011/014930
PCT Pub. Date: Feb. 10, 2011

(65) Prior Publication Data

US 2012/0244051 A1 Sep. 27, 2012

(30) Foreign Application Priority Data

Aug. 7, 2009 (AU) ..... 2009903702

(51) Int. Cl.
*C22B 3/00* (2006.01)

(52) U.S. Cl.
USPC ..... 423/150.1; 75/711

(58) Field of Classification Search
USPC ..... 423/150.1; 75/711
See application file for complete search history.

(56) References Cited

U.S. PATENT DOCUMENTS 1,487,145 A * 3/1924 Caron ..... 423/144
2,928,732 A 3/1960 Bare et al.

(Continued)

FOREIGN PATENT DOCUMENTS

AU 2007201422 A1 10/2007
JP 55-073837 A 6/1980

(Continued)

OTHER PUBLICATIONS

The use of ferrous sulphate to enhance the dissolution of cobaltic minerals; Ferron, C.J., Henry, P., 2008, Hydrometallurgy 2008: Proceedings of the 6th International Symposium, pp. 1088-1097.

(Continued)

*Primary Examiner* — Steven Bos
(74) *Attorney, Agent, or Firm* — Harness, Dickey & Pierce, P.L.C.

(57) ABSTRACT

A method for leaching cobalt from a non-lateritic oxidized cobalt ore, the method comprising the method steps of: curing the non-lateritic oxidized cobalt ore to be leached through the application of an aqueous solution of a cobalt reducing agent selected from the group: iron (II) salts, sulfite salts, sulfur dioxide, and combinations thereof; at a pressure of between about atmospheric pressure and about 5 atmospheres, at a temperature between about 5° C. and about 65° C.; wherein the pH of the aqueous solution of the cobalt reducing agent is between about 1.0 and 10.0; and wherein the relative volumes of the aqueous solution of the cobalt reducing agent and the non-lateritic oxidized cobalt ore to be leached are such that the combination of the aqueous solution of the cobalt reducing agent and the non-lateritic oxidized cobalt ore to be leached forms a mixture with a solids content not less than about 100 g/L of aqueous solution; substantially retaining the aqueous solution of the cobalt reducing agent in contact with the non-lateritic oxidized cobalt; and leaching the cured ore at a pressure of between about atmospheric pressure and about 5 atmospheres, at a temperature between about 5° C. and about 65° C., through the application of an ammonium carbonate solution containing free ammonia thereby producing a pregnant leach solution; then passing the pregnant leach solution resulting to a means for cobalt recovery.

20 Claims, 6 Drawing Sheets

U.S. PATENT DOCUMENTS

| | | | |
|---|---|---|---|
| 3,227,513 | A | 1/1966 | Miroslav et al. |
| 3,848,054 | A | 11/1974 | Wiewiorowski |
| 4,066,733 | A | 1/1978 | Dubeck et al. |

FOREIGN PATENT DOCUMENTS

| | | | |
|---|---|---|---|
| JP | 60-190537 | A | 9/1985 |
| JP | 63-086824 | A | 4/1988 |

OTHER PUBLICATIONS

Use of sulfur dioxide as reducing agent in cobalt leaching at Shituru hydrometallurgical plant; M.D. Mwema, M. Mpoyo, and K. Kafumbila, 2002, Journal of The South African Institute of Mining and Metallurgy 102(1), p. 1-4.

Design of Copper-Cobalt Hydrometallurgical Circuits; G. Miller, 2008, Metallurgical Plant Design and Operating Strategies, AusIMM, p. 447-460.

Inoue, A; Kawahara, M: Ammoniacal leaching and solvent extraction of cobalt crusts using sulfur dioxide gas. Shigen-to-Sozai, vol. 114, pp. 195-199 (1998), Graduate School of Science and Technology, Kumamoto University (Japan). See abstract (in English); tables 1-3; and figures 1-7.

International Search Report and Written Opinion for PCT/AU2010/001003, mailed Oct. 22, 2010; ISA/AU.

* cited by examiner

METHOD FOR LEACHING COBALT FROM OXIDISED COBALT ORES

CROSS REFERENCE TO RELATED APPLICATIONS

This application is a 371 U.S. National Stage of International Application No. PCT/AU2010/001003, filed Aug. 6, 2010, and claims priority to Australian patent application No. 2009903702 filed Aug. 7, 2009, the disclosures of which are herein incorporated by reference in their entirety.

FIELD OF THE INVENTION

The present invention relates to a method for leaching of cobalt from an oxidised cobalt ore. More particularly, the present invention relates to a method for ammoniacally leaching cobalt from a non-lateritic oxidised cobalt ore.

BACKGROUND ART

Current practice is to reduce the as-mined cobalt ore particle size by a combination of crushing and grinding. The ground ore is then added to large leaching tanks containing sulfuric acid. A reductant, most commonly sulfur dioxide, is then added to the tank to reduce insoluble trivalent cobalt to soluble divalent cobalt.

At the Shituru plant, 0.8 tonnes of sodium metabisulfite (SBMS, $Na_2S_2O_5$) and 1.2 tonnes of copper powder were required per tonne of cobalt produced. These consumption figures make cobalt extraction expensive as these reagents comprised 47% of the operating costs for cobalt production. (M. D. Mwema, M. Mpoyo, and K. Kafumbila, Use of sulfur dioxide as reducing agent in cobalt leaching at Shituru hydrometallurgical plant, Journal of The South African Institute of Mining and Metallurgy volume 102, issue 1, 2002, p. 1-4)

To reduce these costs, gaseous sulfur dioxide has been trialled as a replacement for sodium metabisulfite ('SMBS') and copper powder. Tests were performed at 40° C. using ore ground to 80%<74 μm. It was found that by sparging $SO_2$ into the slurry cobalt recovery reached 86% after three hours. However, the sulfur dioxide also reduced iron and manganese within the ore, rendering them soluble in the acidic solution. This increased solubility necessitates further processing to remove these elements from solution giving an increasingly complex, and therefore expensive, flowsheet.

Miller (G. Miller, Design of copper-cobalt hydrometallurgical circuits, Metallurgical Plant Design and Operating Strategies (MetPlant 2008), AusIMM, p. 447-460) notes that "[i]n an acid solution the SMBS disassociates to form $SO_{2\,(aq)}$ which lowers the Eh in solution and reduces the cobalt oxidation state. SMBS is costly and is only partially utilised with side reactions producing sulfuric acid—particularly in the presence of manganese ions in solution." Additionally, "newer projects are considering the use of liquefied $SO_2$" to remove some of the problems surrounding the direct use of $SO_2$ in smelter off gas.

The paper by Miller also examines the removal of impurities from the acidic leach solution, notably iron, manganese, calcium and zinc all of which require removal prior to cobalt concentration and recovery. In this paper, it is stated that > "Iron removal has been undertaken for many years in many hydrometallurgical process plants. The classic method is air oxidation to iron (III) and precipitation with lime and or limestone. All the current and previous Zambian and DRC project use this basic method. However the older style plants all suffer from the usual problems of: downstream gypsum precipitation and fouling of process equipment and pipes."

Miller also noted that for manganese removal

> "The process used to date in Zambia and DRC has been a combined iron and manganese precipitation. This has removed the copper and some zinc; but also co-precipitated significant cobalt which has been lost."

The above summary shows that the acid system for leaching of cobalt has considerable problems, most notably the requirement to remove a suite of impurities by a variety of different methods without significant cobalt losses before cobalt can be recovered.

The method of the present invention has as one object thereof to overcome the abovementioned problems associated with the prior art, or to at least provide a useful alternative thereto.

Throughout this specification, unless the context requires otherwise, the word "comprise", or variations such as "comprises" or "comprising", will be understood to imply the inclusion of a stated integer or group of integers but not the exclusion of any other integer or group of integers.

The discussion of the background art is included exclusively for the purpose of providing a context for the present invention. It should be appreciated that the discussion is not an acknowledgement or admission that any of the material referred to was common general knowledge in the field relevant to the present invention in Australia or elsewhere before the priority date.

DISCLOSURE OF THE INVENTION

In accordance with the present invention there is provided a method for leaching cobalt from a non-lateritic oxidised cobalt ore, the method comprising the method steps of:

- curing the non-lateritic oxidised cobalt ore to be leached through the application of an aqueous solution of a cobalt reducing agent selected from the group: iron (II) salts, sulfite salts, sulfur dioxide, and combinations thereof; at a pressure of between about atmospheric pressure and about 5 atmospheres, at a temperature between about 5° C. and about 65° C.;
- wherein the pH of the aqueous solution of the cobalt reducing agent between about 1.0 and 10.0; and wherein the relative volumes of the aqueous solution of the cobalt reducing agent and the non-lateritic oxidised cobalt ore to be leached are such that the combination of the aqueous solution of the cobalt reducing agent and the non-lateritic oxidised cobalt ore to be leached forms a mixture with a solids content not less than about 100 g/L of aqueous solution;
- substantially retaining the aqueous solution of the cobalt reducing agent in contact with the non-lateritic oxidised cobalt; and
- leaching the cured ore at a pressure of between about atmospheric pressure and about 5 atmospheres, at a temperature between about 5° C. and about 65° C., through the application of an ammonium carbonate solution containing free ammonia thereby producing a pregnant leach solution; then
- passing the pregnant leach solution resulting to a means for cobalt recovery.

In accordance with the present invention there is provided a method for leaching cobalt from a non-lateritic oxidised cobalt ore, the method comprising the method steps of:

- curing the non-lateritic oxidised cobalt ore to be leached through the application of an aqueous solution of an iron (II) salt at a pressure of between about atmospheric pressure and about 5 atmospheres, at a temperature between about 5° C. and about 65° C.;

wherein the pH of the aqueous solution of the cobalt reducing agent between about 1.0 and 4.5; and wherein the relative volumes of the aqueous solution of the cobalt reducing agent and the non-lateritic oxidised cobalt ore to be leached are such that the combination of the aqueous solution of the cobalt reducing agent and the non-lateritic oxidised cobalt ore to be leached forms a mixture with a solids content not less than about 100 g/L of aqueous solution;

substantially retaining the aqueous solution of the cobalt reducing agent in contact with the non-lateritic oxidised cobalt; and leaching the cured ore at a pressure of between about atmospheric pressure and about 5 atmospheres, at a temperature between about 5° C. and about 65° C., through the application of an ammonium carbonate solution containing free ammonia thereby producing a pregnant leach solution; then passing the pregnant leach solution resulting to a means for cobalt recovery.

In accordance with the present invention there is provided a method for leaching cobalt from a non-lateritic oxidised cobalt ore, the method comprising the method steps of:

curing the non-lateritic oxidised cobalt ore to be leached through the application of an aqueous solution of a sulfite salt at a pressure of between about atmospheric pressure and about 5 atmospheres, at a temperature between about 5° C. and about 65° C.;

wherein the pH of the aqueous solution of the cobalt reducing agent between about 1.0 and 10.0; and wherein the relative volumes of the aqueous solution of the cobalt reducing agent and the non-lateritic oxidised cobalt ore to be leached are such that the combination of the aqueous solution of the cobalt reducing agent and the non-lateritic oxidised cobalt ore to be leached forms a mixture with a solids content not less than about 100 g/L of aqueous solution;

substantially retaining the aqueous solution of the cobalt reducing agent in contact with the non-lateritic oxidised cobalt; and leaching the cured ore at a pressure of between about atmospheric pressure and about 5 atmospheres, at a temperature between about 5° C. and about 65° C., through the application of an ammonium carbonate solution containing free ammonia thereby producing a pregnant leach solution; then passing the pregnant leach solution resulting to a means for cobalt recovery.

In accordance with the present invention there is provided a method for leaching cobalt from a non-lateritic oxidised cobalt ore, the method comprising the method steps of:

curing the non-lateritic oxidised cobalt ore to be leached through the application of an aqueous solution of a sulfur dioxide at a pressure of between about atmospheric pressure and about 5 atmospheres, at a temperature between about 5° C. and about 65° C.;

wherein the pH of the aqueous solution of the cobalt reducing agent between about 1.0 and 10.0; and wherein the relative volumes of the aqueous solution of the cobalt reducing agent and the non-lateritic oxidised cobalt ore to be leached are such that the combination of the aqueous solution of the cobalt reducing agent and the non-lateritic oxidised cobalt ore to be leached forms a mixture with a solids content not less than about 100 g/L of aqueous solution;

substantially retaining the aqueous solution of the cobalt reducing agent in contact with the non-lateritic oxidised cobalt; and leaching the cured ore at a pressure of between about atmospheric pressure and about 5 atmospheres, at a temperature between about 5° C. and about 65° C., through the application of an ammonium carbonate solution containing free ammonia thereby producing a pregnant leach solution; then passing the pregnant leach solution resulting to a means for cobalt recovery.

Acid leaching solutions require purification to remove the other dissolved metals prior to cobalt recovery. Purification typically results in large volumes of iron precipitate and, in many cases, gypsum assuming lime or dolomite is used to raise the pH. These residues need to be disposed of in an environmentally acceptable manner. The high likelihood of dissolving hazardous elements, such as As, Sb, Se, Tl etc present in the ore in the intensive conditions of acid leaching also places constraints on the disposal of residues. The capital and operating costs of such precipitation processes can form a substantial part of the overall budget for the plant.

According to Sinclair (Extractive Metallurgy of Zinc, AusIMM, Spectrum Series 15, 2005, p. 265-272) the capital cost of leaching, iron precipitation, gypsum removal, effluent treatment and residue disposal is around 25-30% of the total capital cost (US$200M) of a 100000 tpa roast-leach-electrowin plant. The operating cost of these processes was around 20% of the total operating costs (US$45.3M) of the same plant. Clearly, any reduction of costs in these areas will give much improved economic viability.

Ammoniacal leach solutions contain fewer undesirable metals at lower concentrations. The high purity of the ammoniacal solutions in comparison to the acid solutions enables a simpler plant to be constructed as there will not need to be any whole-of-solution precipitation circuit to remove iron and/or manganese. However, conventional ammoniacal leaching techniques do not provide the extent of recovery of the acid-based leaches.

In the stringent economic context in which cobalt recovery plants operate, the combination of an acid circuit with an ammoniacal circuit is clearly counter intuitive, with the resulting neutralisation reaction providing a considerable economic deterrent. An alternate strategy may be to conduct sequential acidic then ammoniacal (or vice versa) leaches, however this would necessitate the construction of separate acid and ammoniacal cobalt recovery circuits and is thus unviable in any practical sense.

However, the inventors have discovered that low volumes of at most mildly acidic aqueous solutions of certain reducing agents have a highly advantageous affect on the subsequent ammoniacal leaching of non-lateritic oxidised cobalt ores. The volumes are sufficiently low, and the solutions sufficiently mild that the ore need not be separated from the aqueous solution of the reducing agent prior to the addition of the ammoniacal leaching solution, thereby obviating the need for a solid-liquid separation step prior to the leach step, avoiding both process complexities and its inherent cost, and the likely loss of cobalt from solution adsorbed to the surface of the treated ore.

The inventors have discovered that it is possible to effect economic cobalt recovery from non-lateritic oxidised cobalt ores by ammoniacal leaching under mild (and, therefore low cost) conditions, by prior application of aqueous solutions of specific cobalt reducing agents also under mild (and therefore low cost) conditions. The inventors have, however, undertaken analogous experiments on lateritic nickel ores with little effect.

Furthermore, the method of the present invention provides for a highly effective ammoniacal leach of cobalt, the efficacy of the ammoniacal leach step of the two step process being enhanced relative to conventional one step ammoniacal leaches of cobalt. The higher selectivity of ammoniacal leaching for cobalt also provides a cleaner leach solution less in need of treatment for the removal of non-target metals than equivalent solutions from acid processes. The process minimises expected, and highly economically undesirable, reagent loss from the combination of the acidic and basic solutions be employing low volumes of mildly acidic solutions which, given their mild nature and the mild conditions under which the treatment occurs, are surprisingly effective at enhancing the efficacy of the ammoniacal leach.

Solids Content

Mixtures of ore and aqueous solution of curing agent of the invention s encompass mixtures with extremely high solids contents, such as pastes, and mixtures where solid ore is merely moistened by the addition of aqueous solution of the cobalt reducing agent.

In a preferred form of the invention, the mixture formed by the combination of the aqueous solution of the cobalt reducing agent and the non-lateritic oxidised cobalt ore to be leached has solids content not less than about 100 g/L. In a preferred form of the invention, the mixture formed by the combination of the aqueous solution of the cobalt reducing agent and the non-lateritic oxidised cobalt ore to be leached has solids content not less than about 200 g/L. In a preferred form of the invention, the mixture formed by the combination of the aqueous solution of the cobalt reducing agent and the non-lateritic oxidised cobalt ore to be leached has solids content not less than about 400 g/L. In a preferred form of the invention, the mixture formed by the combination of the aqueous solution of the cobalt reducing agent and the non-lateritic oxidised cobalt ore to be leached has solids content not less than about 700 g/L. In a preferred form of the invention, the mixture formed by the combination of the aqueous solution of the cobalt reducing agent and the non-lateritic oxidised cobalt ore to be leached has solids content not less than about 1000 g/L. In a preferred form of the invention, the mixture formed by the combination of the aqueous solution of the cobalt reducing agent and the non-lateritic oxidised cobalt ore to be leached has solids content not less than about 2000 g/L. In a preferred form of the invention, the mixture formed by the combination of the aqueous solution of the cobalt reducing agent and the non-lateritic oxidised cobalt ore to be leached has solids content not less than about 4000 g/L. In a preferred form of the invention, the mixture formed by the combination of the aqueous solution of the cobalt reducing agent and the non-lateritic oxidised cobalt ore to be leached has solids content not less than about 7000 g/L. In a preferred form of the invention, the mixture formed by the combination of the aqueous solution of the cobalt reducing agent and the non-lateritic oxidised cobalt ore to be leached has solids content not less than about 10000 g/L. In a preferred form of the invention, the mixture formed by the combination of the aqueous solution of the cobalt reducing agent and the non-lateritic oxidised cobalt ore to be leached has solids content not less than about 20000 g/L. In a preferred form of the invention, the mixture formed by the combination of the aqueous solution of the cobalt reducing agent and the non-lateritic oxidised cobalt ore to be leached has solids content not less than about 40000 g/L. In a preferred form of the invention, the mixture formed by the combination of the aqueous solution of the cobalt reducing agent and the non-lateritic oxidised cobalt ore to be leached has solids content not less than about 50000 g/L.

In one form of the invention, the solids content of the mixture falls within a range of contents having a lower limit of 100 g/L. In a preferred form of the invention, the range of contents has a lower limit of 200 g/L. In a preferred form of the invention, the range of contents has a lower limit of 400 g/L. In a preferred form of the invention, the range of contents has a lower limit of 700 g/L. In a preferred form of the invention, the range of contents has a lower limit of 1000 g/L. In a preferred form of the invention, the range of contents has a lower limit of 2000 g/L. In a preferred form of the invention, the range of contents has a lower limit of 4000 g/L. In a preferred form of the invention, the range of contents has a lower limit of 7000 g/L. In a preferred form of the invention, the range of contents has a lower limit of 10000 g/L. In a preferred form of the invention, the range of contents has a lower limit of 20000 g/L. In a preferred form of the invention, the range of contents has a lower limit of 40000 g/L. In a preferred form of the invention, the range of contents has a lower limit of 50000 g/L.

In one form of the invention, the solids content of the mixture falls within a range of contents having an upper limit of 100000 g/L. In one form of the invention, the solids content of the mixture falls within a range of contents having an upper limit of 50000 g/L. In one form of the invention, the solids content of the mixture falls within a range of contents having an upper limit of 40000 g/L. In one form of the invention, the solids content of the mixture falls within a range of contents having an upper limit of 20000 g/L.

Limitation of the relative volume of the aqueous solution of the cobalt reducing agent is a key feature of the invention as it, together with the relatively mild acidities that have found to be effective, enables economic combination of an acid solution (the present invention does encompass the use of basic solutions, such as basic sulfite solutions) of the cobalt reducing agent and the ammoniacal leaching solution.

Sulfite Solutions

Throughout this specification, unless the context requires otherwise, reference to aqueous solutions of sulfite encompasses sulfite derivatives such as metabisulfite.

Non-Lateritic Oxidised Cobalt Ores

In one form of the invention, the non-lateritic oxidised cobalt ore is selected from the group: sedimentary hydrothermal (including stratabound), volcanogenic hydrothermal, polymetallic uranium or skarn deposits.

In one form of the invention, the non-lateritic oxidised cobalt ore has a cobalt content in excess of any nickel content.

Throughout this specification, unless the context requires otherwise, the phrase "non-lateritic oxidised cobalt ore" should be understood to encompass oxidised cobalt ores that include a sulfide component, and oxide ores that have been derived from mixed sulfide-oxide ores by way of separation techniques, such as flotation.

Curing

As would be understood by a person skilled in the art, the term curing is fundamentally distinct from leaching. Leaching describes a process by which a solution containing a leaching agent is contacted with an ore, the solution recovered and valuable metals extracted therefrom. The curing step of the present invention renders the ore to be leached more amenable to the leaching process, improving both the extent and rate of recovery of cobalt.

As would be understood by a person skilled in the art, in many applications, it is virtually impossible to completely retain a solution in contact with the ore to be leached. For example, in a heap leaching context, it is virtually impossible to stop drainage from the ore.

Curing Temperature

Preferably still, the step of curing the oxidised cobalt ore takes place at a temperature between about 10° C. and 50° C. Further and still preferably, the step of curing the oxidised cobalt ore takes place at a temperature between about 10° C. and 45° C. Further and still preferably, the step of curing the oxidised cobalt ore takes place at a temperature between about 10° C. and 40° C. Further and still preferably, the step of curing the oxidised cobalt ore takes place at a temperature between about 10° C. and 35° C. Further and still preferably, the step of curing the oxidised cobalt ore takes place at a temperature between about 10° C. and 30° C.

Preferably still, the step of curing the oxidised cobalt ore takes place at a temperature between ambient temperature and 50° C. Further and still preferably, the step of curing the oxidised cobalt ore takes place at a temperature between ambient temperature and 45° C. Further and still preferably, the step of curing the oxidised cobalt ore takes place at a temperature between ambient temperature and 40° C. Further and still preferably, the step of curing the oxidised cobalt ore takes place at a temperature between ambient temperature and 35° C. Further and still preferably, the step of curing the oxidised cobalt ore takes place at a temperature between ambient temperature and 30° C.

In a highly preferred form of the invention, the step of curing the non-lateritic oxidised cobalt ore takes place at ambient temperature.

Leaching Temperature

Preferably still, the step of leaching the cured ore takes place at a temperature between about 10° C. and 50° C. Further and still preferably, the step of leaching the cured ore takes place at a temperature between about 10° C. and 45° C. Further and still preferably, the step of leaching the cured ore takes place at a temperature between about 10° C. and 40° C. Further and still preferably, the step of leaching the cured ore takes place at a temperature between about 10° C. and 35° C. Further and still preferably, the step of leaching the cured ore takes place at a temperature between about 10° C. and 30° C.

Preferably still, the step of leaching the cured ore takes place at a temperature between ambient temperature and 50° C. Further and still preferably, the step of leaching the cured ore takes place at a temperature between ambient temperature and 45° C. Further and still preferably, the step of leaching the cured ore takes place at a temperature between ambient temperature and 40° C. Further and still preferably, the step of leaching the cured ore takes place at a temperature between ambient temperature and 35° C. Further and still preferably, the step of leaching the cured ore takes place at a temperature between ambient temperature and 30° C.

In a highly preferred form of the invention, the step of leaching the cured ore takes place at ambient temperature.

Curing Pressure

In a highly preferred form of the invention, the step of curing the non-lateritic oxidised cobalt ore takes place at atmospheric pressure.

Leaching Pressure

In a highly preferred form of the invention, the step of leaching the cured ore takes place at atmospheric pressure.

Cobalt Reducing Agent Dosage

In a preferred form of the invention, the step of:

curing the non-lateritic oxidised cobalt ore to be leached through the application of an aqueous solution of a cobalt reducing agent selected from the group: iron (II) salts, sulfite salts, sulfur dioxide, and combinations thereof; at a pressure of between about atmospheric pressure and about 5 atmospheres, at a temperature between about 5° C. and about 65° C.;

more specifically comprises the step of:

curing the non-lateritic oxidised cobalt ore to be leached through the application of an aqueous solution of a cobalt reducing agent selected from the group: iron (II) salts, sulfite salts, sulfur dioxide, and combinations thereof; at a pressure of between about atmospheric pressure and about 5 atmospheres, at a temperature between about 5° C. and about 65° C. through the application of an aqueous solution of an amount cobalt reducing agent corresponding to between 0.2 and 20.0 times the amount of cobalt present in the oxidised cobalt ore, on a stoichiometric basis.

In a preferred form of the invention, the amount of cobalt reducing agent is between about 0.5 and 10.0 times the amount of cobalt present in the oxidised cobalt ore, on a stoichiometric basis.

In a preferred form of the invention, the amount of cobalt reducing agent is between about 0.5 and 3.0 times the amount of cobalt present in the oxidised cobalt ore, on a stoichiometric basis.

As would be understood by a person skilled in the art, the equation representing the reduction of cobalt (III) by iron (II) is as follows $$Fe^{2+}+Co^{3+}\rightarrow Fe^{3+}+Co^{2+}$$

As would be understood by a person skilled in the art, the equation representing the reduction of cobalt (III) by sulfite (using sodium sulfite as an example)/sulfur dioxide are as follows:

$$SO_2+2Co^{3+}+2H_2O\rightarrow SO_4^{2-}+2Co^{2+}+4H^+;$$

or $$Na_2SO_3+2Co^{3+}+H_2O\rightarrow Na_2SO_4+2Co^{2+}+2H^+.$$

Accordingly, where the cobalt reducing agent is iron (II), the amount cobalt reducing agent corresponding to between 0.2 and 20.0 times the amount of cobalt present in the oxidised cobalt ore, on a stoichiometric basis corresponds to between 0.2 and 20.0 times the amount of cobalt present in the oxidised cobalt ore on a molar basis. Where the cobalt reducing agent is sulfite/sulfur dioxide, the amount cobalt reducing agent corresponding to between 0.2 and 20.0 times the amount of cobalt present in the oxidised cobalt ore, on a stoichiometric basis corresponds to between 0.4 and 12.0 times the amount of cobalt present in the oxidised cobalt ore on a molar basis.

Anyone skilled in the art will recognise that the stoichiometry is not solely determined by the cobalt concentration in the ore as there may well be other reducible species present in the ore. Consequently, the actual stoichiometry will be different for each ore and can only be determined by testwork.

Curing pH and Concentration

In preferred forms of the invention, where the reductant is an iron (II) salt, the concentration of the iron (II) salt is between about 0.5 g/L and about 100 g/L (expressed in terms of iron (II) sulfate). Preferably still, the concentration of the iron (II) salt is between about 5 g/L and about 100 g/L (expressed in terms of iron (II) sulfate). Preferably still, the concentration of the iron (II) salt is between about 10 g/L and about 100 g/L (expressed in terms of iron (II) sulfate). Preferably still, the concentration of the iron (II) salt is between about 25 g/L and about 100 g/L (expressed in terms of iron (II) sulfate). Preferably still, the concentration of the iron (II) salt is between about 50 g/L and about 100 g/L (expressed in terms of iron (II) sulfate). In a highly preferred form of the invention, the concentration of the iron (II) salt is about 100 g/L (expressed in terms of iron (II) sulfate).

In preferred forms of the invention, where the reductant is an iron (II) salt, the concentration of the iron (II) salt is between about 0.5 g/L and about 200 g/L (expressed in terms of iron (II) sulfate). Preferably still, the concentration of the iron (II) salt is between about 5 g/L and about 200 g/L (expressed in, terms of iron (II) sulfate). Preferably still, the concentration of the iron (II) salt is between about 10 g/L and about 200 g/L (expressed in terms of iron (II) sulfate). Preferably still, the concentration of the iron (II) salt is between about 25 g/L and about 200 g/L (expressed in terms of iron (II) sulfate). Preferably still, the concentration of the iron (II) salt is between about 50 g/L and about 200 g/L (expressed in terms of iron (II) sulfate). Preferably still, the concentration of the iron (II) salt is between about 100 g/L and about 200 g/L (expressed in terms of iron (II) sulfate). In a highly preferred form of the invention, the concentration of the iron (II) salt is about 200 g/L (expressed in terms of iron (II) sulfate).

In preferred forms of the invention, where the reductant is an iron (II) salt, the concentration of the iron (II) salt is between about 0.5 g/L and saturation. Preferably still, the concentration of the iron (II) salt is between about 5 g/L and saturation. Preferably still, the concentration of the iron (II) salt is between about 10 g/L and saturation. Preferably still, the concentration of the iron (II) salt is between about 25 g/L and saturation. Preferably still, the concentration of the iron (II) salt is between about 50 g/L and saturation. Preferably still, the concentration of the iron (II) salt is between about 100 g/L and saturation. In a highly preferred form of the invention, the solution is saturated by the iron (II) salt.

While economics dictate that the aqueous solution of the cobalt reducing agent have as high a pH as possible, thereby minimising ammonia loss from the leach solution, the efficacy of the preferred reducing agents places considerable restraints on this requirement.

In a preferred form of the invention, where the reductant is an iron (II) salt, the pH of the aqueous solution of the iron (II) salt is between about 1.0 and about 4.5. Preferably still, the pH of the solution is between about 1.5 and 4.5. Preferably still, the pH of the solution is between about 2.0 and 4.5. Preferably still, the pH of the solution is between about 2.5 and 4.5. In a highly preferred form of the invention, the pH of the solution is between about 3.0 and about 4.5. The latter pH range corresponds to the inherent acidity of iron (III) solutions, across the range of concentrations of utility in the present invention, without the addition of further acid. As will be recognised by a person skilled in the art, the inherent pH of an iron (III) solution will vary with the concentration and identity of the counter ion.

The concentration of the curing solution that may be used will be affected by the pH. The solubility of iron (II) ions decreases with increasing pH until it reaches a minimum at around pH 11. However, to maintain a concentration of iron (II) ions suitable for use as a reductant requires a pH below around 7. Iron (II) converts to iron (III) after completing the reduction reaction and iron (III) solubility is also affected by pH reaching a minimum solubility at pH 4-9. At a pH below around 3, the iron (III) ions formed may be sufficiently soluble to migrate away from the reduction site thereby preventing blocking of the surface through formation of a solid iron (III) phase. The examples presented below do not indicate any blocking of the surface by iron (III) precipitates at pH 3.

In preferred forms of the invention, where the reductant is a sulfite salt and/or $SO_2$, the concentration of the sulfite salt is between about 0.5 g/L and about 100 g/L (expressed in terms of sodium sulfite). Preferably still, the concentration of the sulfite salt is between about 10 g/L and about 100 g/L (expressed in terms of sodium sulfite). Preferably still, the concentration of the sulfite salt is between about 50 g/L and about 100 g/L (expressed in terms of sodium sulfite). Preferably still, the concentration of the sulfite salt is between about 100 g/L and about 100 g/L (expressed in terms of sodium sulfite). In a highly preferred form of the invention, the concentration of the sulfite salt is about 100 g/L (expressed in terms of sodium sulfite).

In preferred forms of the invention, where the reductant is a sulfite salt and/or $SO_2$, the concentration of the sulfite salt is between about 0.5 g/L and about 200 g/L (expressed in terms of sodium sulfite). Preferably still, the concentration of the sulfite salt is between about 10 g/L and about 200 g/L (expressed in terms of sodium sulfite). Preferably still, the concentration of the sulfite salt is between about 25 g/L and about 200 g/L (expressed in terms of sodium sulfite). Preferably still, the concentration of the sulfite salt is between about 50 g/L and about 200 g/L (expressed in terms of sodium sulfite). Preferably still, the concentration of the sulfite salt is between about 100 g/L and about 200 g/L (expressed in terms of sodium sulfite). In a highly preferred form of the invention, the concentration of the sulfite salt is about 200 g/L (expressed in terms of sodium sulfite).

In preferred forms of the invention, where the reductant is a sulfite salt and/or $SO_2$, the concentration of the sulfite salt is between about 0.5 g/L and about saturation. Preferably still, the concentration of the sulfite salt is between about 10 g/L and about saturation. Preferably still, the concentration of the sulfite salt is between about 100 g/L and about saturation. Preferably still, the concentration of the sulfite salt is between about 50 g/L and about saturation. Preferably still, the concentration of the sulfite salt is between about 100 g/L and about saturation. In a highly preferred form of the invention, the solution is saturated by the sulfite salt.

For sodium sulfite the main effect of pH is to change the speciation of the sulfite ion, below about pH 2.5 it is present as dissolved $SO_2$ sometimes written $SO_2$ (aq), above pH 2.5 the predominant species is $HSO_3^-$. Sulfur dioxide has a limited solubility in water and this also decreases with pH, so losses of $SO_2$ to atmosphere will be greater at lower pH. In the preparation of the pH adjusted sulfite solutions utilised in the examples discussed below the odour of $SO_2$ was increasingly strong as the desired starting solution pH was decreased.

In preferred forms of the invention, where the reductant is a sulfite salt and/or $SO_2$, the pH is preferably less than 10. In preferred forms of the invention, where the reductant is a sulfite salt and/or $SO_2$, the pH is preferably less than 8. In preferred forms of the invention, where the reductant is a sulfite salt and/or $SO_2$, the pH is preferably less than 6. In preferred forms of the invention, where the reductant is a sulfite salt and/or $SO_2$, the pH is preferably between about 5 and 6.

Leaching: Ammonium Carbonate Solution Containing Free Ammonia

Ammonium Carbonate

Ammonium carbonate fixes the operating pH to a relatively narrow range and is, to some extent, self-regulating as the ammonium carbonate acts as a buffer. Importantly, the pH range buffered by the ammonium carbonate is a range in which a wide variety of target metals are soluble. A second advantage of carbonate systems is that there is less prospect of gypsum scaling as the sulfate level is always too low for precipitation to occur. The calcium level will also be low as the precipitation of $CaCO_3$ will occur whenever calcium ions are released into solution.

Preferably, the ammonium carbonate concentration of the ammonium carbonate solution containing free ammonia is sufficient to prevent the pH decreasing below 8 during the step of leaching the cured ore at atmospheric pressure through the application of an ammonium carbonate solution containing free ammonia, producing a pregnant leach solution.

Preferably, the ammonium carbonate concentration of the ammonium carbonate solution containing free ammonia is at least 1 g/L. Preferably still, the concentration of ammonium carbonate is at least 5 g/L. Preferably still, the ammonium carbonate concentration of the ammonium carbonate solution containing free ammonia is at least 8 g/L. Preferably still, the ammonium carbonate concentration of the ammonium carbonate solution containing free ammonia is at least 10 g/L. Preferably still, the ammonium carbonate concentration of the ammonium carbonate solution containing free ammonia is at least 20 g/L. Preferably still, the ammonium carbonate concentration of the ammonium carbonate solution containing free ammonia is at least 30 g/L.

Preferably, the ammonium carbonate concentration of the ammonium carbonate solution containing free ammonia is between 1 g/L and saturation. Preferably still, the concentration of ammonium carbonate is between 5 g/L and saturation. Preferably still, the ammonium carbonate concentration of the ammonium carbonate solution containing free ammonia is between 8 g/L and saturation. Preferably still, the ammonium carbonate concentration of the ammonium carbonate solution containing free ammonia is between 10 g/L and saturation. Preferably still, the ammonium carbonate concentration of the ammonium carbonate solution containing free ammonia is between 20 g/L and saturation. Preferably still, the ammonium carbonate concentration of the ammonium carbonate solution containing free ammonia is between 30 g/L and saturation.

Preferably, the ammonium carbonate concentration of the ammonium carbonate solution containing free ammonia is between 1 g/L and 100 g/L. Preferably still, the concentration of ammonium carbonate is between 5 g/L and 100 g/L. Preferably still, the ammonium carbonate concentration of the ammonium carbonate solution containing free ammonia is between 8 g/L and 100 g/L. Preferably still, the ammonium carbonate concentration of the ammonium carbonate solution containing free ammonia is between 10 g/L and 100 g/L. Preferably still, the ammonium carbonate concentration of the ammonium carbonate solution containing free ammonia is between 20 g/L and 100 g/L. Preferably still, the ammonium carbonate concentration of the ammonium carbonate solution containing free ammonia is between 30 g/L and 100 g/L.

Preferably, the ammonium carbonate concentration of the ammonium carbonate solution containing free ammonia is between 1 g/L and 50 g/L. Preferably still, the concentration of ammonium carbonate is between 5 g/L and 50 g/L. Preferably still, the ammonium carbonate concentration of the ammonium carbonate solution containing free ammonia is between 8 g/L and 50 g/L. Preferably still, the ammonium carbonate concentration of the ammonium carbonate solution containing free ammonia is between 10 g/L and 50 g/L. Preferably still, the ammonium carbonate concentration of the ammonium carbonate solution containing free ammonia is between 20 g/L and 50 g/L. Preferably still, the ammonium carbonate concentration of the ammonium carbonate solution containing free ammonia is between 30 g/L and 50 g/L.

Preferably, the ammonium carbonate concentration of the ammonium carbonate solution containing free ammonia is between 1 g/L and 20 g/L. Preferably still, the concentration of ammonium carbonate is between 5 g/L and 20 g/L. Preferably still, the ammonium carbonate concentration of the ammonium carbonate solution containing free ammonia is between 8 g/L and 20 g/L. Preferably still, the ammonium carbonate concentration of the ammonium carbonate solution containing free ammonia is between 10 g/L and 20 g/L.

Ammonia

The ammonia of the ammonium carbonate solution containing free ammonia may be generated in situ, such as by hydrolysis of urea.

The free ammonia concentration of the ammonium carbonate solution containing free ammonia may be tailored to the rate at which the cobalt is leached from the cured ore, thereby minimising excess free ammonia and thus minimising ammonia losses due to evaporation. Specifically, the resulting pregnant leach solution preferably contains only a slight excess of free ammonia over that necessary to retain the cobalt in solution. As there is little free ammonia in the pregnant leach solution, ammonia losses due to evaporation are low.

A person skilled in the art will readily be able to calculate the free ammonia concentration required to retain cobalt in solution at a desired concentration. The conditions under which ammoniacal complexes of cobalt form are readily calculable based on data contained in NIST Standard Reference Database 46, NIST Critically Selected Stability Constants of Metal Complexes: Version 6.0, the contents of which are incorporated by reference.

Similarly, a person skilled in the art will readily be able to calculate the free ammonia concentration required to retain all soluble metals in solution at a desired concentration in the case of ores where other metals soluble in ammonia are also present.

In a preferred form of the invention, the free ammonia concentration of the ammoniacal leach solution is about 2 to 20 g/L ammonia. In a preferred form of the invention, the free ammonia concentration of the ammoniacal leach solution is about 2 to 40 g/L ammonia. In a preferred form of the invention, the free ammonia concentration of the ammoniacal leach solution is about 2 to 60 g/L ammonia. In a preferred form of the invention, the free ammonia concentration of the ammoniacal leach solution is about 2 to 80 g/L ammonia. In a preferred form of the invention, the free ammonia concentration of the ammoniacal leach solution is about 2 to 100 g/L ammonia. In a preferred form of the invention, the free ammonia concentration of the ammoniacal leach solution is about 2 to 200 g/L ammonia. In a preferred form of the invention, the free ammonia concentration of the ammoniacal leach solution is about 2 g/L to saturation.

As would be realised by a person skilled in the art the level of ammonia in the leach solution would be matched to the level of cobalt in the ore and the rate at which it leaches. A low grade ore where the cobalt leaches slowly would require a lower concentration of ammonia than a high grade ore where the leaching is rapid. This invention encompasses ores containing ammonia-soluble metals in addition to cobalt and for these ores a higher ammonia concentration would be required.

Extent of Recovery

In one form of the invention, the step of leaching the cured ore at a pressure of between about atmospheric pressure and about 5 atmospheres, at a temperature between about 5° C. and about 65° C., through the application of a leaching solution thereby producing a pregnant leach solution more specifically comprises the step of:

leaching the cured ore at a pressure of between about atmospheric pressure and about 5 atmospheres, at a temperature between about 5° C. and about 65° C., through the application of a leaching solution thereby producing a pregnant leach solution in which at least 20% of the cobalt initially present in the oxidised cobalt ore is dissolved.

In a preferred form of the invention, the pregnant leach solution contains at least 25% of the cobalt initially present in the oxidised cobalt ore. In a preferred form of the invention, the pregnant leach solution contains at least 30% of the cobalt initially present in the oxidised cobalt ore. In a preferred form of the invention, the pregnant leach solution contains at least 35% of the cobalt initially present in the oxidised cobalt ore. In a preferred form of the invention, the pregnant leach solution contains at least 40% of the cobalt initially present in the oxidised cobalt ore. In a preferred form of the invention, the pregnant leach solution contains at least 50% of the cobalt initially present in the oxidised cobalt ore. In a preferred form of the invention, the pregnant leach solution contains at least 55% of the cobalt initially present in the oxidised cobalt ore. In a preferred form of the invention, the pregnant leach solution contains at least 60% of the cobalt initially present in the oxidised cobalt ore. In a preferred form of the invention, the pregnant leach solution contains at least 65% of the cobalt initially present in the oxidised cobalt ore. In a preferred form of the invention, the pregnant leach solution contains at least 70% of the cobalt initially present in the oxidised cobalt ore. In a preferred form of the invention, the pregnant leach solution contains at least 75% of the cobalt initially present in the oxidised cobalt ore. In a preferred form of the invention, the pregnant leach solution contains at least 80% of the cobalt initially present in the oxidised cobalt ore. In a preferred form of the invention, the pregnant leach solution contains at least 85% of the cobalt initially present in the oxidised cobalt ore. In a preferred form of the invention, the pregnant leach solution contains at least 90% of the cobalt initially present in the oxidised cobalt ore. In a preferred form of the invention, the pregnant leach solution contains at least 95% of the cobalt initially present in the oxidised cobalt ore.

In a preferred form of the invention, the pregnant leach solution contains a percentage of the cobalt initially present in the oxidised cobalt ore within a range having a lower value of 20%. In one form of the invention, the lower value is 25%. In one form of the invention, the lower value is 30%. In one form of the invention, the lower value is 35%. In one form of the invention, the lower value is 40%. In one form of the invention, the lower value is 45%. In one form of the invention, the lower value is 50%. In one form of the invention, the lower value is 55%. In one form of the invention, the lower value is 60%. In one form of the invention, the lower value is 65%. In one form of the invention, the lower value is 70%. In one form of the invention, the lower value is 75%. In one form of the invention, the lower value is 80%. In one form of the invention, the lower value is 85%. In one form of the invention, the lower value is 90%. In one form of the invention, the lower value is 95%.

In a preferred form of the invention, the pregnant leach solution contains a percentage of the cobalt initially present in the oxidised cobalt ore within a range having an upper value of 100%. In a preferred form of the invention, the pregnant leach solution contains a percentage of the cobalt initially present in the oxidised cobalt ore within a range having an upper value of 99%. In a preferred form of the invention, the pregnant leach solution contains a percentage of the cobalt initially present in the oxidised cobalt ore within a range having an upper value of 95%.

The present invention encompasses simultaneously leaching more than one target metal. The target metals may be separated by the means for metal recovery, such as by solvent extraction.

It should be understood that the most desirable conditions under which the cured cobalt ore is ammoniacally leached will vary as the conditions under which the ore is cured vary. In particular, the ammonia concentration of the leach solution may be tailored to the rate at which the target metal is leached from the cured ore.

It should be understood that the most desirable conditions under which the ore is to be leached will vary as the composition of the ore varies. For example, the nature and concentration of the leaching agent, the temperature at which the leaching step occurs, and the time for which the ore is leached may all be varied in response to the composition of the ore.

Similarly, it should be understood that the most desirable leaching conditions will vary as the conditions under which the ore is cured vary. In particular, the leachant concentration of the solution may be tailored to the rate at which the cobalt is leached from the cured ore.

The means for metal recovery of the present invention may comprise one or more solvent extraction stages.

Means for Cobalt Recovery

In one form of the invention, the means for cobalt recovery is provided in the form of a solvent extraction step. In one form of the invention, the means for cobalt recovery comprises a solvent extraction step, followed by an electrowinning step comprising the formation of a cobalt cathode. In one form of the invention, the means for cobalt recovery comprises a solvent extraction step, followed by a precipitation step comprising the formation of an insoluble cobalt salt.

BRIEF DESCRIPTION OF THE DRAWINGS

The present invention will now be described, by way of example only, with reference to one embodiment thereof and the accompanying drawings, in which:—

BEST MODE(S) FOR CARRYING OUT THE INVENTION

Figure 1:
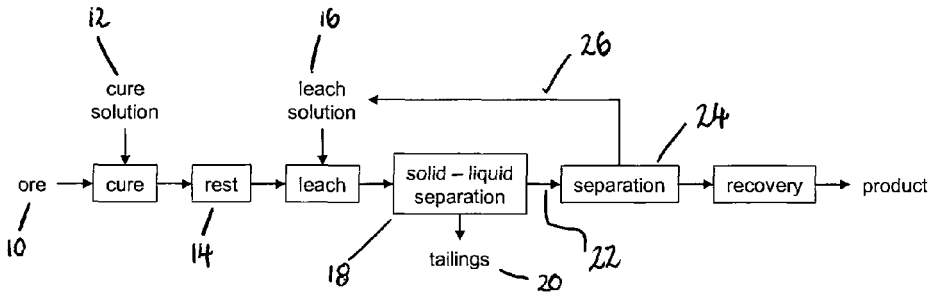
FIG. 1 is a schematic flow sheet of a method for leaching one or more target metals from an ore in accordance with the present invention.

A method for leaching cobalt from a non-lateritic oxidised cobalt ore in accordance with one embodiment of the present invention is now described. A copper-cobalt oxide ore is used as the basis for this disclosure.

The ore 10 is crushed and ground as necessary prior to the addition of a cure solution 12 comprising sodium sulfite at pH 2, wherein the volume of the curing solution added is as low as possible, such as approximately 250 mL/kg. The concentration of sodium sulfite is chosen such that all of the trivalent cobalt in the ore is reduced to divalent. Every ore will have different levels of trivalent cobalt and the optimum addition of reductant needs to be determined for each ore. If no reductant is used then cobalt dissolution is greatly decreased.

After application of the cure solution the mixture is allowed to rest 14 for 12 h. Every combination of ore and cure solution will require different resting times and the optimum resting time needs to be determined for each ore.

After resting, the ore is added to a volume of ammoniacal ammonium carbonate leach solution 16 sufficient to form a slurry containing 400 g of cured ore per liter of leach solution. Every combination of cured ore and leach solution will require a different slurry density, residence time, leach solution composition and concentration. The optimum slurry density, residence time, leach solution composition and concentration needs to be determined for each ore.

Once the ore has been leached the slurry is passed to a solid-liquid separation stage 18. The copper and cobalt depleted solids 20 are discarded whilst the metal bearing solution 22 passes to separation 24. The metal bearing solution is contacted with Cyanex 272 dissolved in kerosene, the cobalt transfers into the organic phase which is allowed to settle and is separated. The organic phase is separately contacted with sulfuric acid at pH 2 and the cobalt transfers into the aqueous phase from which it can be recovered by, for example, precipitation or electrowinning. The cobalt-depleted organic 26 is recycled to the cobalt loading stage.

In an alternate embodiment of the invention (not shown) where copper is also present, the solvent extraction process comprises a bulk extraction using LIX841, followed by a sequential strip for cobalt (and ammonia), then for copper.

EXAMPLES

In the first group of examples, a non-lateritic oxidised copper cobalt ore was used, the headgrades being 5.14% Cu and 0.64% Co. The copper was present as readily leachable malachite, the cobalt mineralogy was not determined but was likely to be present as heterogenite (CoOOH).

Example 1

Samples of ore were cured by adding just enough of a variety of different solutions to wet the surface of the ore, the resultant pastes were left for 24 h to rest. AAC—20 g/L ammonium carbonate+20 g/L free ammonia; AMM—70 g/L free ammonia; SAC—40 g/L ammonium carbonate+70 g/L free ammonia.

After 24 h, a solution of AAC was added to give a slurry density of 10 g/L. The solution was agitated for 24 h after which time the solution was analysed for copper and cobalt. The results are shown in FIG. 2.

Figure 2:
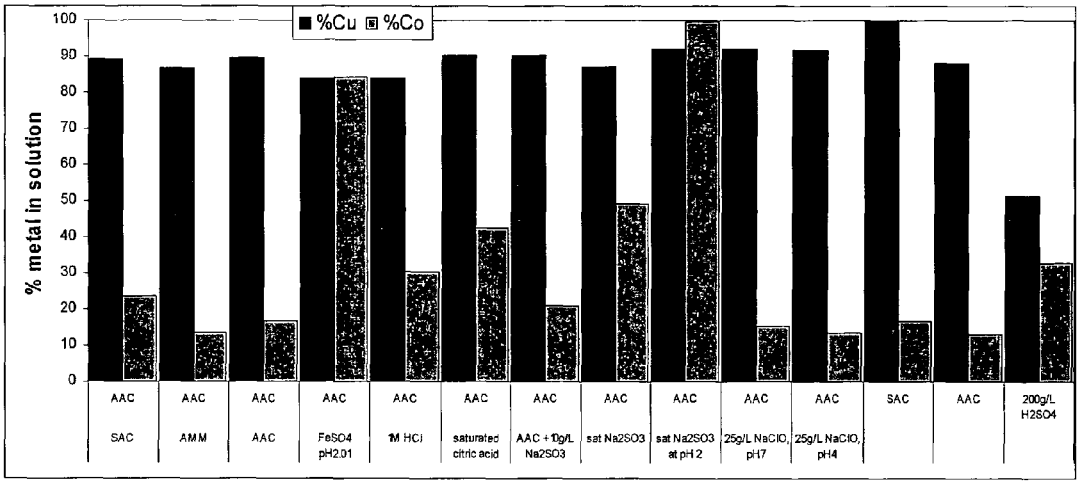
FIG. 2 is a graph showing the extent of dissolution of the copper and cobalt for each of the cure agents of Example 1.

FIG. 2 shows the extent of dissolution of the copper and cobalt for each cure. The rightmost three data sets are for dissolution without a prior cure. From this it can be seen that copper dissolution is unaffected by curing with almost all runs achieving >80% dissolution. However, the cobalt dissolution is highly dependent upon the cure, the two most effective cures were those containing the reductants iron (II) sulfate and saturated sodium sulfite both of which were adjusted to pH 2 using sulfuric acid. The ineffectiveness of non-reductive acid curing is shown by the poor recovery from the 1M HCl. Oxidative curing (NaClO) was ineffective.

Example 2

Samples of ore were cured by adding just enough solution to wet the surface of the ore, the resultant pastes were left for 24 h to rest. The solutions used were saturated sodium sulfite and this solution adjusted to lower pH using sulfuric acid.

Figure 3:
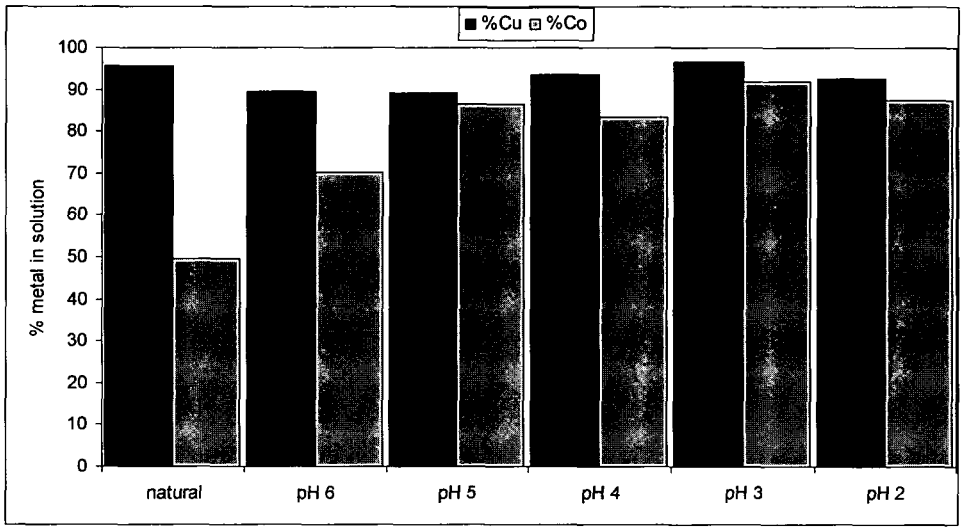
FIG. 3 is a graph showing the extent of dissolution of the copper and cobalt for the various starting pH's of the samples of Example 2.

After 24 h, a solution of AAC was added to give a slurry density of 10 g/L. The solution was agitated for 24 h after which time the solution was analysed for copper and cobalt. FIG. 3 shows that providing the starting pH of the cure solution is 5 or lower the cure is effective in enhancing cobalt solubility. As before, the copper recovery was unaffected by the curing conditions.

Example 3

Samples of ore were cured by adding just enough saturated sodium sulfite solution adjusted to pH2 using sulfuric acid to wet the surface of the ore, the resultant pastes were left for up to 24 h to rest.

Figure 4:
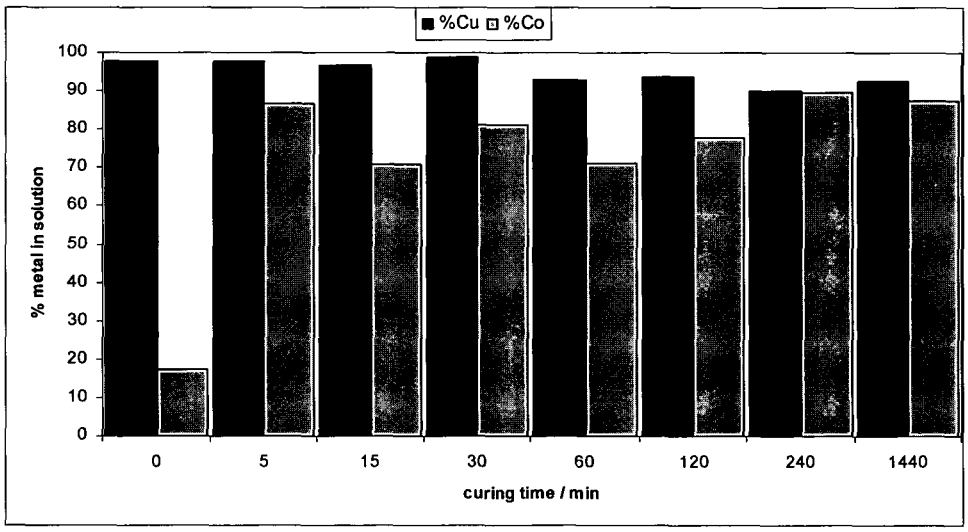
FIG. 4 is a graph showing the extent of dissolution of the copper and cobalt for the various curing times relied on in Example 3.

After the requisite time, a solution of AAC was added to give a slurry density of 10 g/L. The solution was agitated for 24 h after which time the solution was analysed for copper and cobalt. FIG. 4 shows that a resting time of five minutes was sufficient for the chemical reaction enhancing the dissolution of cobalt to occur. The copper recovery was unaffected by resting time.

Example 4

Leaching Time

Samples of ore were cured by adding 13 mL saturated sodium sulfite solution adjusted to pH2 using sulfuric acid to 50.0 g of ore.

Figure 5:
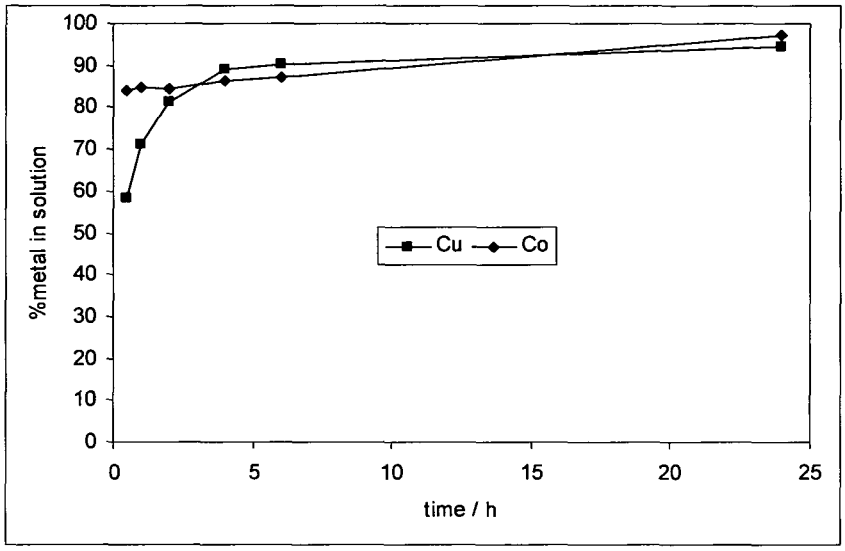
FIG. 5 shows the extent of leaching over time of the sample of Example 4.

After 24 h resting, the cured ore was added to 500.0 mL of AAC. Solution samples were taken periodically and analysed for copper and cobalt. FIG. 5 shows the extent of leaching with time. Clearly, the cobalt dissolution is extremely rapid with 84% dissolved inside 30 minutes. Copper dissolution was somewhat slower with 2 h needed to achieve 80% dissolution. After 24 h, >95% of both metals was dissolved into solution.

Example 5

As discussed above, one of the key advantages of the ammoniacal leach of the invention over prior art acid-based leaching systems is the cleanliness of the leach solution. The final leach solution obtained from Example 4 was analysed for the presence of metals commonly present in such ores. The analysis is shown in the table below, the data is given in mg/L (parts per million). The high sodium level is due to the use of sodium sulfite in the cure solution.

| Fe | Mg | Mn | Na | V | Y | Zn |
|---|---|---|---|---|---|---|
| 1.5 | 7.8 | 9.6 | 3100 | 0.4 | 0.3 | 1.2 |

The following elements were all below detection limits, Ag, Al, Ba, Bi, Ca, Cd, Cr, K, Li, Mo, Ni, P, Pb, Sr, Ti and Zr.

Most importantly, the levels of the metals which result in problems in acid leaching plants, notably Fe, Mn, Ca and Zn, are extremely low. At these levels the metals will not require specific unit operations for removal and the solution can be passed directly to a process for separation and recovery of cobalt and copper. As would be apparent to a person skilled in the art, this is a distinct advantage of the invention over prior art methods.

Example 6

Samples of ore were cured using solutions containing increasing concentrations of either sodium sulfite or iron (II) sulfate both adjusted to pH 2. A copper cobalt ore was used, the headgrades were 5.14% Cu and 0.64% Co. The copper was present as readily leachable malachite, the cobalt mineralogy was not determined but was likely to be present as heterogenite (CoOOH). Equal volumes of solution were added to equal masses of ore to provide different doses of the two curing agents. After 24 h rest time AAC was added and leaching allowed to proceed for 24 h. The solutions were separated and analysed for copper and cobalt.

Figure 6:
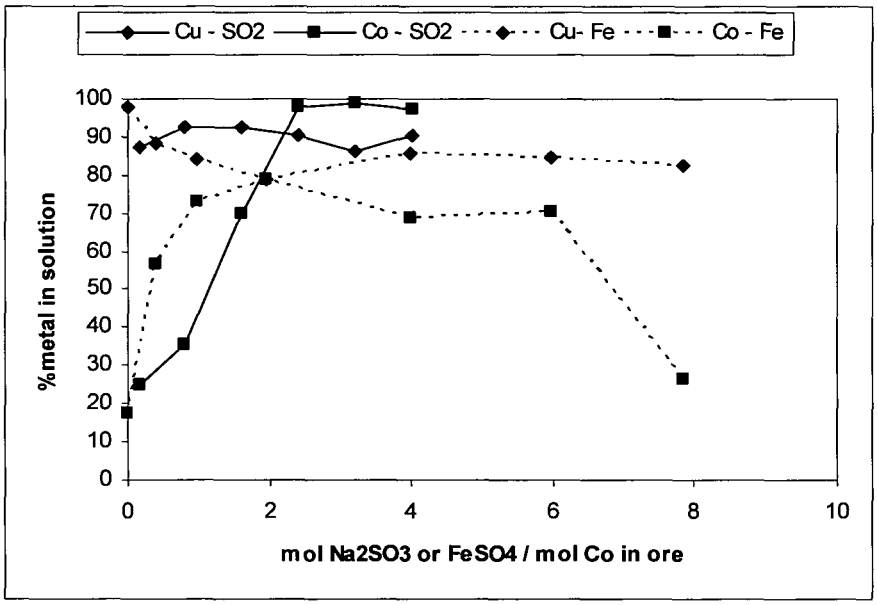
FIG. 6 shows the extent of leaching with the various curing agents tested in Example 6.

FIG. 6 shows that the curing agent has a slight detrimental effect on copper recovery with the >95% recovery for uncured ore reducing to ~90% in the presence of sodium sulfite and to 80-85% in the presence of iron (II) sulfate. The effect on cobalt was more dramatic with dissolution increasing from <20% in uncured ore to >80% when >=2 moles of sodium sulfite per mole of Co in the ore was used as cure. The iron (II) sulfate solution showed greater effect at lower molar ratios although a molar ratio of ~2 was necessary to achieve ~80% recovery, above 4 mole Fe/mole Co the recovery decreased and at 8:1 was only slightly better than uncured ore. Clearly, too much iron (II) sulfate is detrimental to the recovery of cobalt. Without wishing to be bound by theory, it is believed that a high iron (II) concentration will result in precipitation of iron-cobalt phases which are insoluble in the AAC leaching solution.

In Examples 7-10 a non-lateritic oxidised copper-cobalt ore also containing a small amount of nickel was used, the headgrades were 2.51% Cu, 0.223% Co and 0.098% Ni. The copper was present primarily as malachite, the cobalt mineralogy was not determined but was likely to be present as heterogenite (CoOOH).

Example 7

Figure 7:
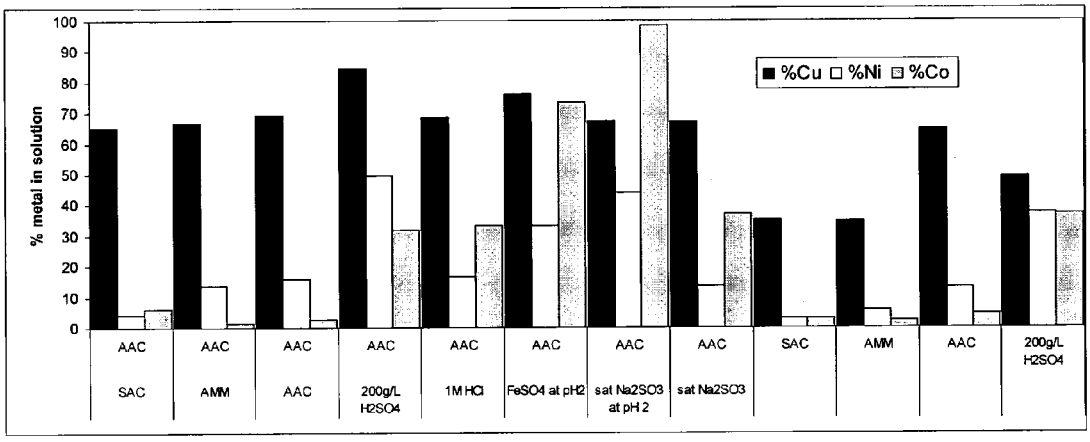
FIG. 7 is a graph showing the extent of dissolution of the copper, cobalt and nickel with the various curing agents of Example 7.

Samples of ore were cured by adding just enough of a variety of different solutions to wet the surface of the ore, the resultant pastes were left for 24 h to rest. AAC—20 g/L ammonium carbonate+20 g/L free ammonia; AMM—70 g/L free ammonia; SAC—40 g/L ammonium carbonate+70 g/L free ammonia After 24 h, a solution of AAC was added to give a slurry density of 10 g/L. The solution was agitated for 24 h after which time the solution was analysed for copper, cobalt and nickel, the results being shown in FIG. 7.

As can be seen the samples cured in iron (II) sulfate and sodium sulfite adjusted to pH 2 were the most effective at enhancing cobalt recovery. Acid curing was not effective as shown by the lower recoveries for samples cured in 200 g/L $H_2SO_4$ and 1M HCl. Without wishing to be bound by theory, these two reagents are reducing agents and act on the cobalt (III) present to change it to cobalt(II). Cobalt(III) is insoluble whilst cobalt(II) is readily soluble in the AAC leaching solution. The extent of leaching of nickel also changed with cure used. The strong acid was most effective but the reductive cures also increased nickel dissolution but not to the same extent as for cobalt. Without wishing to be bound by theory, the nickel is in one, or more, different mineral phases to the cobalt, one, or more, of which, but not all are amenable to a reduction which releases nickel into solution. The strong acid would rely on its low pH to effect a dissolution of a nickel bearing phase.

Example 8

Figure 8:
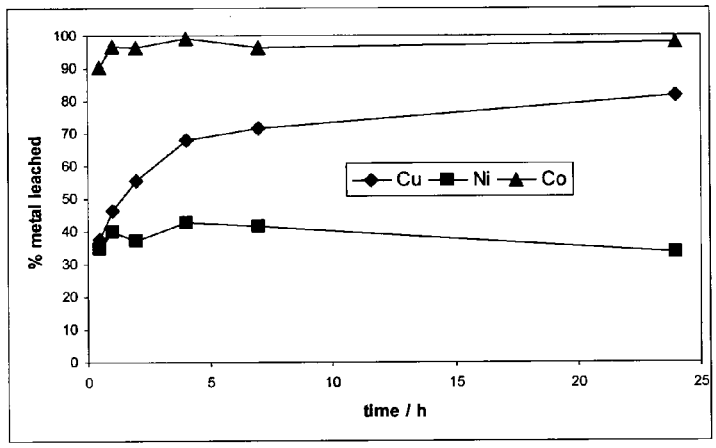
FIG. 8 shows the extent of leaching over time of the sample of Example 8.

Further samples were cured for 24 h using saturated sodium sulfite adjusted to pH2. They were then leached for up to 24 h in AAC. FIG. 8 shows that leaching of cobalt was extremely rapid with the maximum extent of dissolution completed within 1 h. Copper leaching was somewhat slower and appears to continue beyond 24 h. The amount of nickel leached was smaller indicating that the reductive cure was not acting effectively on all nickeliferous phases.

Example 9

Samples of ore were cured by adding just enough saturated sodium sulfite solution adjusted to pH2 using sulfuric acid to wet the surface of the ore, the resultant pastes were left for up to 24 h to rest.

Figure 9:
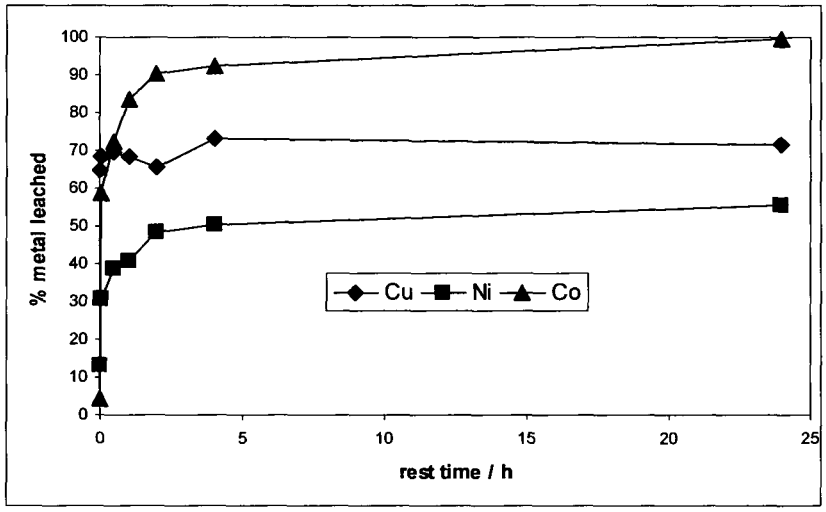
FIG. 9 shows the extent of leaching over curing time of the sample of Example 9.

After the requisite time, a solution of AAC was added to give a slurry density of 10 g/L. The solution was agitated for 24 h after which time the solution was analysed for copper and cobalt. FIG. 9 shows that a resting time of five minutes was sufficient to increase the cobalt recovery from <5% to 59%. A rest time of two hours was necessary for the chemical reaction enhancing the dissolution of cobalt to above 90% to occur. Longer rest times increased the cobalt recovery, but only marginally. The copper recovery was essentially unaffected by resting time.

Example 10

As stated above, in the second group of examples a non-lateritic copper-cobalt ore also containing a small amount of nickel was used, the headgrades were 2.51% Cu, 0.223% Co and 0.098% Ni. The copper was present primarily as malachite, the cobalt mineralogy was not determined but was likely to be present as heterogenite (CoOOH).

Samples of ore were cured using solutions containing increasing concentrations of either sodium sulfite or iron (II) sulfate both adjusted to pH 2. Equal volumes of solution were added to equal masses to provide different masses of the two curing agents. After 24 h rest time AAC was added and leaching allowed to proceed for 24 h. The solutions were separated and analysed for copper, cobalt and nickel.

Figure 10:
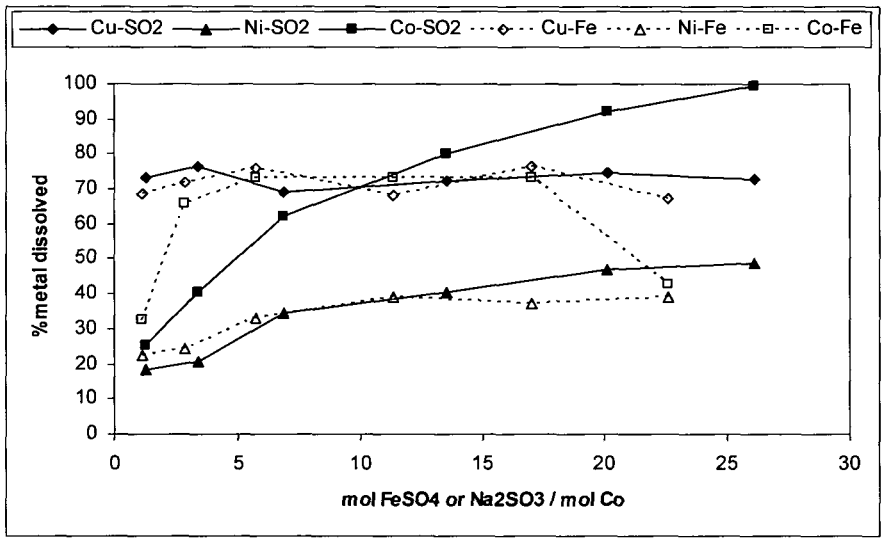
FIG. 10 is a graph showing the extent of dissolution of the copper, cobalt and nickel with various curing agents on the samples of Example 10.

FIG. 10 shows the extent of metal dissolution after curing in sodium sulfite ($SO_2$) or iron (II) sulfate (Fe). As in all other examples using this ore the copper recovery is unaffected by the curing agent. Nickel recovery increased as the stoichiometric amount of reductant increased but appeared limited to <50%. Cobalt recovery increased with stoichiometry of sodium sulfite achieving almost 100% for a molar ratio of 26:1. With iron (II) sulfate the recovery increased to a maximum of around 70% at a molar ratio of 6:1, higher stoichiometries had no clear effect until >17:1 above which a lower cobalt recovery was recorded. Without wishing to be bound by theory, the sodium sulfite is a more powerful reductant than the iron (II) ions and therefore can reduce phases that the iron (II) cannot. This suggests that cobalt is present in two phases, one which contains around 70% of the cobalt is reducible by both reductants whilst the second phase is only reducible by the sodium sulfite. The apparent drop off in cobalt recovery in the most concentrated iron (II) sulfate solution may be due to precipitation of a mixed iron-cobalt phase which is not soluble in the AAC leaching solution used.

Without wishing to be bound by theory, a comparison of this data with that from Example 6 shows that this ore requires a significantly higher stoichiometric ratio of reductant (i.e. iron (II) ions or sulfite ions) to cobalt. As would be clear to one skilled in the art the stoichiometric ratio of reductant to cobalt is dependent upon several factors, including the distribution of cobalt within the ore, the phase(s) within which the cobalt is present and the presence of other reducible phases which do not contain cobalt.

Example 11

Two components of laterite ores, limonite (1.3% Ni and 0.3% Co) and saprolite (1.8% Ni and 0.1% Co) were cured by adding just enough solution to wet the surface of the ore, the resultant mixtures were left for 24 h to rest. The solutions tested were 100 g/L sodium sulfite adjusted to pH 2, 4 and 6. For comparison a cure using 200 g/L sulfuric acid was also trialled.

After 24 h, a solution comprising 20 g/L ammonium carbonate+20 g/L free ammonia was added to give a slurry density of 40 g/L. The solution was agitated for 24 h after which time the solution was analysed for nickel.

Figure 11:
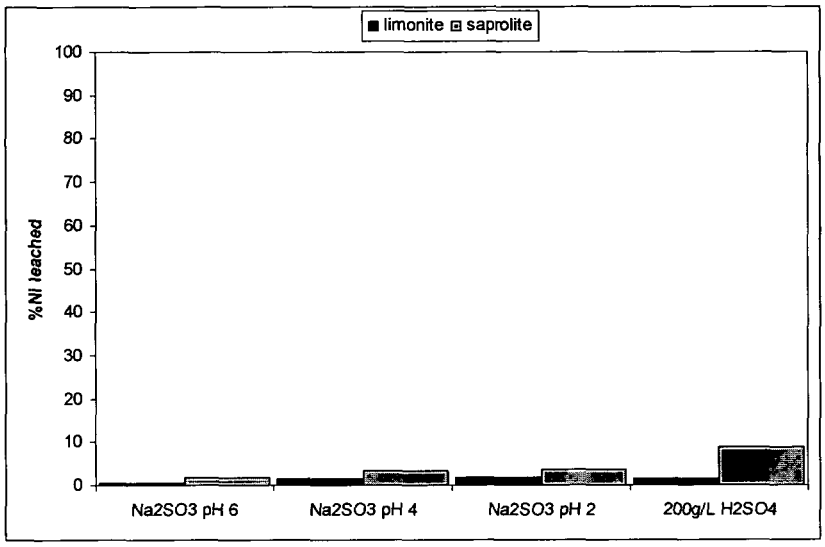
FIG. 11 shows the dissolution of nickel for the cure solutions tested in Example 11.

FIG. 11 shows the dissolution of nickel for the cure solutions tested. Clearly, none of the cured ores trialled gave substantial improvement in nickel recovery that has been exemplified for non-laterite ores. The strong sulfuric acid cure was the most effective of the four cures shown, however recovery remained below 10%. Clearly, for laterite ores reductive curing is ineffective.

The claim defining the invention is as follows:

1. A method for leaching cobalt from a non-lateritic oxidised cobalt ore, the method comprising the method steps of:

curing the non-lateritic oxidised cobalt ore by application of an aqueous solution of a cobalt reducing agent selected from the group consisting of: iron (II) salts, sulfite salts, sulfur dioxide, and combinations thereof; at a pressure of between about atmospheric pressure and about 5 atmospheres, at a temperature between about 5° C. and about 65° C.;

wherein the pH of the aqueous solution of the cobalt reducing agent is between about 1.0 and 10.0; and wherein the combination of the aqueous solution of the cobalt reducing agent and the non-lateritic oxidised cobalt ore forms a mixture having a solids content not less than about 100 g/L of aqueous solution;

substantially retaining the aqueous solution of the cobalt reducing agent in contact with the non-lateritic oxidised cobalt ore; and leaching the cured ore at a pressure of between about atmospheric pressure and about 5 atmospheres, at a temperature between about 5° C. and about 65° C., through the application of an ammonium carbonate solution containing free ammonia thereby producing a pregnant leach solution; then passing the pregnant leach solution to a means for cobalt recovery.

2. The method according to claim 1, wherein at least 20% of the cobalt initially present in the oxidised cobalt ore is dissolved in the pregnant leach solution.

3. The method according to claim 1, wherein the mixture formed by the combination of the aqueous solution of the cobalt reducing agent and the non-lateritic oxidised cobalt ore has solids content not less than about 100 g/L.

4. The method according to claim 1, wherein the mixture formed by the combination of the aqueous solution of the cobalt reducing agent and the non-lateritic oxidised cobalt ore has solids content not less than about 5000 g/L.

5. The method according to claim 1, wherein the mixture formed by the combination of the aqueous solution of the cobalt reducing agent and the non-lateritic oxidised cobalt ore has solids content not less than about 20000 g/L.

6. The method according to claim 1, wherein the mixture formed by the combination of the aqueous solution of the cobalt reducing agent and the non-lateritic oxidised cobalt ore has solids content of between about 100 g/L and about 10000 g/L.

7. The method according to claim 1, wherein the mixture formed by the combination of the aqueous solution of the cobalt reducing agent and the non-lateritic oxidised cobalt ore has solids content of between about 100 g/L and about 40000 g/L.

8. The method according to claim 1, wherein the non-lateritic oxidised cobalt ore is selected from the group consisting of: sedimentary hydrothermal, stratabound hydrothermal, volcanogenic hydrothermal, polymetallic uranium and skarn deposits.

9. The method according to claim 1, wherein the non-lateritic oxidised cobalt ore has a cobalt content in excess of any nickel content.

10. The method according to claim 1, wherein the step of curing the oxidised cobalt ore takes place at a temperature between about 10° C. and 50° C.

11. The method according to claim 1, wherein the step of curing the non-lateritic oxidised cobalt ore takes place at ambient temperature.

12. The method according to claim 1, wherein the step of leaching the cured ore takes place at a temperature between about 10° C. and 50° C.

13. The method according to claim 1, wherein the step of leaching the cured ore takes place at ambient temperature.

14. The method according to claim 1, wherein the step of curing the non-lateritic oxidised cobalt ore takes place at atmospheric pressure.

15. The method according claim 1, wherein the step of leaching the non-lateritic oxidised cobalt ore takes place at atmospheric pressure.

16. The method according to claim 1, wherein the step of:

curing the non-lateritic oxidised cobalt ore by application of an aqueous solution of a cobalt reducing agent selected from the group consisting of: iron (II) salts, sulfite salts, sulfur dioxide, and combinations thereof; at a pressure of between about atmospheric pressure and about 5 atmospheres, at a temperature between about 5° C. and about 65° C.;

further comprises:

the application of an aqueous solution of an amount of cobalt reducing agent corresponding to between 0.2 and 20.0 times the amount of cobalt present in the oxidised cobalt ore, on a stoichiometric basis.

17. The method according to claim 16 wherein the amount of cobalt reducing agent is between about 0.5 and 10.0 times the amount of cobalt present in the oxidised cobalt ore, on a stoichiometric basis.

18. The method according to claim 16 wherein the amount of cobalt reducing agent is between about 0.5 and 3.0 times the amount of cobalt present in the oxidised cobalt ore, on a stoichiometric basis.

19. The method according to claim 1, wherein the ammonium carbonate concentration of the ammonium carbonate solution containing free ammonia is sufficient to prevent the pH decreasing below 8 during the step of leaching the cured ore at atmospheric pressure.

20. The method according to claim 16, wherein at least 20% of the cobalt initially present in the oxidised cobalt ore is dissolved in the pregnant leach solution.

* * * * *